US006159601A

United States Patent [19]

Pitowski et al.

[11] Patent Number: 6,159,601

[45] Date of Patent: Dec. 12, 2000

[54] PROCESS FOR THE MANUFACTURE OF CELLULOSIC FIBERS; AND CELLULOSIC FIBERS

[75] Inventors: Hans-Jürgen Pitowski, Miltenberg; Ulrich Wigand Wachsmann, Elsenfeld, both of Germany

[73] Assignee: Akzo Nobel NV, Arnhem, Netherlands

[21] Appl. No.: 09/241,374

[22] Filed: Feb. 2, 1999

Related U.S. Application Data

[62] Division of application No. 09/004,100, Jan. 7, 1998, Pat. No. 5,958,320.

[30] Foreign Application Priority Data

Jan. 9, 1997 [DE] Germany ..... 197 00 424

[51] Int. Cl.[7] ..... D01F 2/00

[52] U.S. Cl. ..... 428/393; 428/364

[58] Field of Search ..... 428/364, 393

[56] References Cited

U.S. PATENT DOCUMENTS

| | | | |
|---|---|---|---|
| 2,319,305 | 5/1943 | De Nooij et al. . | |
| 4,246,221 | 1/1981 | McCorsley, III . | |
| 4,416,698 | 11/1983 | McCorsley, III . | |
| 5,403,530 | 4/1995 | Taylor . | |
| 5,601,771 | 2/1997 | Rüf . | |
| 5,958,320 | 9/1999 | Pitowski et al. | 264/187 |

FOREIGN PATENT DOCUMENTS

| | | |
|---|---|---|
| 691 426 A2 | 1/1996 | European Pat. Off. . |
| 2913589 | 9/1980 | Germany . |
| 244 366 A1 | 4/1987 | Germany . |
| 196 00 572 A1 | 7/1997 | Germany . |
| WO 95/30043 | 11/1995 | WIPO . |
| WO 96 06207 | 2/1996 | WIPO . |
| WO 96/07777 | 3/1996 | WIPO . |
| WO 96/07779 | 3/1996 | WIPO . |
| WO 96/20301 | 7/1996 | WIPO . |
| WO 96 27700 | 9/1996 | WIPO . |

OTHER PUBLICATIONS

Derwent Abstract AN 95–383273, English–language Abstract for WO 96/07779.

Derwent Abstract AN 96–321869, English–language Abstract for WO 96/20301.

Derwent Abstract AN 97–352093, English–language Abstract for 196 00 572 A1.

Derwent Abstract AN 87–228828, English–language Abstract for 244 366 A1.

*Primary Examiner*—Newton Edwards

*Attorney, Agent, or Firm*—Oliff & Berridge, PLC

[57] ABSTRACT

Cellulosic fibers made from a solution of cellulose in a tertiary amine oxide and optionally water and which have a low tendency to fibrillate are produced by coagulating the fibers in at least two stages. The residence time of the fibers in the first coagulation stage is adjusted so that on leaving the first coagulation stage only the adhesiveness of the surface of the solution formed into fibers has been counteracted. In subsequent coagulation stages, the fibers are kept in a slack state. On leaving the final coagulation stage, the fibers have been thoroughly coagulated. The cellulosic fibers have a new structure and apart from a very low tendency to fibrillate, they possess a high dyeing level.

10 Claims, 1 Drawing Sheet

PROCESS FOR THE MANUFACTURE OF CELLULOSIC FIBERS; AND CELLULOSIC FIBERS

This is a Division of application Ser. No. 09/004,100 filed Jan. 7, 1998 U.S. Pat. No. 5,958,320. The entire disclosure of the prior application is hereby incorporated by reference herein in its entirety.

BACKGROUND OF THE INVENTION

The invention relates to a process for the manufacture of cellulosic fibers from a solution of cellulose in a tertiary amine oxide and possibly water, whereby the solution formed into fibers through a spinneret is coagulated in at least two stages and the fibers are subsequently washed and dried; and to cellulosic fibers.

A process for the manufacture of cellulosic fibers from a solution of cellulose in a tertiary amine oxide and water, which are also known as Lyocell or solvent-spun fibers, is described for example in U.S. Pat. No. 4,246,22 1. In this so-called Lyocell process, cellulose is dissolved in an organic solvent such as N-methylmorpholine-N-oxide (NMMO). The solution, which may also contain water and possibly a stabilizer such as gallic acid propyl ester, is extruded through a spinneret into an air gap to form fibers or filaments and then coagulated in a coagulation bath. Following the coagulation bath is a withdrawal component such as a galette, over which the fibers are guided under tension. With the help of further galettes the fibers are transported on to the next treatment steps. These are usually fiber washing, finishing, drying and winding up.

Lyocell fibers exhibit a strong tendency to fibrillate. WO95/30043, WO96/07777, WO96/07779 and EP-A-0 691 426 propose measures for reducing the tendency of Lyocell fibers to fibrillate. These measures comprise the addition of additives to the coagulation agent, the use of special gases in the air gap or the post-treatment of the fibers with chemicals such as crosslinking agents. However, these methods have the drawback that in view of ensuring that the process is performed in an environmentally-friendly manner, the chemicals additionally introduced into the process have to be recovered by special methods, as a result of which the processes become more difficult and expensive.

WO96/20301 also discloses a process for the manufacture of formed cellulose objects such as fibers or filaments from a solution of cellulose in a tertiary amine oxide. The fibers made according to this publication, which are also claimed to have a reduced tendency to fibrillation, have a core-sheath structure. In the core of the fibers there is a highly ordered hypermolecular configuration with small, finely dispersed pores and in the sheath there is a relatively unordered hypermolecular configuration with large heterogeneous cavities. The core-sheath structure of the fibers is achieved by guiding the fibers formed from the solution through at least two coagulation baths, one after the other, whereby in the first coagulation bath the cellulose is coagulated more slowly than in the final coagulation bath. For this purpose, the first coagulation bath might be an alcoholic bath such as hexanol or a mixture of hexanol and isopropanol. In the second coagulation bath an aqueous NMMO might be used, whereby the first coagulation bath is arranged directly above the second coagulation bath. This process for manufacturing core-sheath fibers, too, exhibits the drawback that additional chemicals have to be introduced to the process. These additional substances get into the washing water of the baths following coagulation, along with the tertiary amine oxide used to prepare the solution.

The Lyocell process is known to be particularly environmentally friendly since the tertiary amine oxide used to prepare the solution can be almost completely recovered and returned to the solution preparation process. The use of other chemical substances makes this recovery more difficult and is thus detrimental to the economic efficiency of the process.

SUMMARY OF THE INVENTION

It is thus the object of the invention to make available a process for the manufacture of Lyocell fibers with a reduced tendency to fibrillate in which it is not necessary to include additional chemicals. It is furthermore the object of the invention to make available Lyocell fibers which, aside from possessing a reduced tendency to fibrillate, exhibit a higher dyeing level than conventional Lyocell fibers.

This object is fulfilled with a process for the manufacture of cellulosic fibers from a solution of cellulose in a tertiary amine oxide and possibly water, whereby the solution formed into fibers through a spinneret is coagulated in at least two stages and the fibers are subsequently washed and dried, and whereby the coagulation takes place in at least two stages such that the residence time of the fibers in the first coagulation stage is adjusted so that on leaving the first coagulation stage only the adhesiveness of the surface of the solution formed into fibers has been counteracted and in subsequent coagulation stages the fibers are kept in a slack state and on leaving the final coagulation stage have been thoroughly coagulated.

BRIEF DESCRIPTION OF THE DRAWING

The FIGURE illustrates a wet abrasion test apparatus for evaluating the fibrillation tendency of fibers.

DETAILED DESCRIPTION OF PREFERRED EMBODIMENTS

Figure 1:
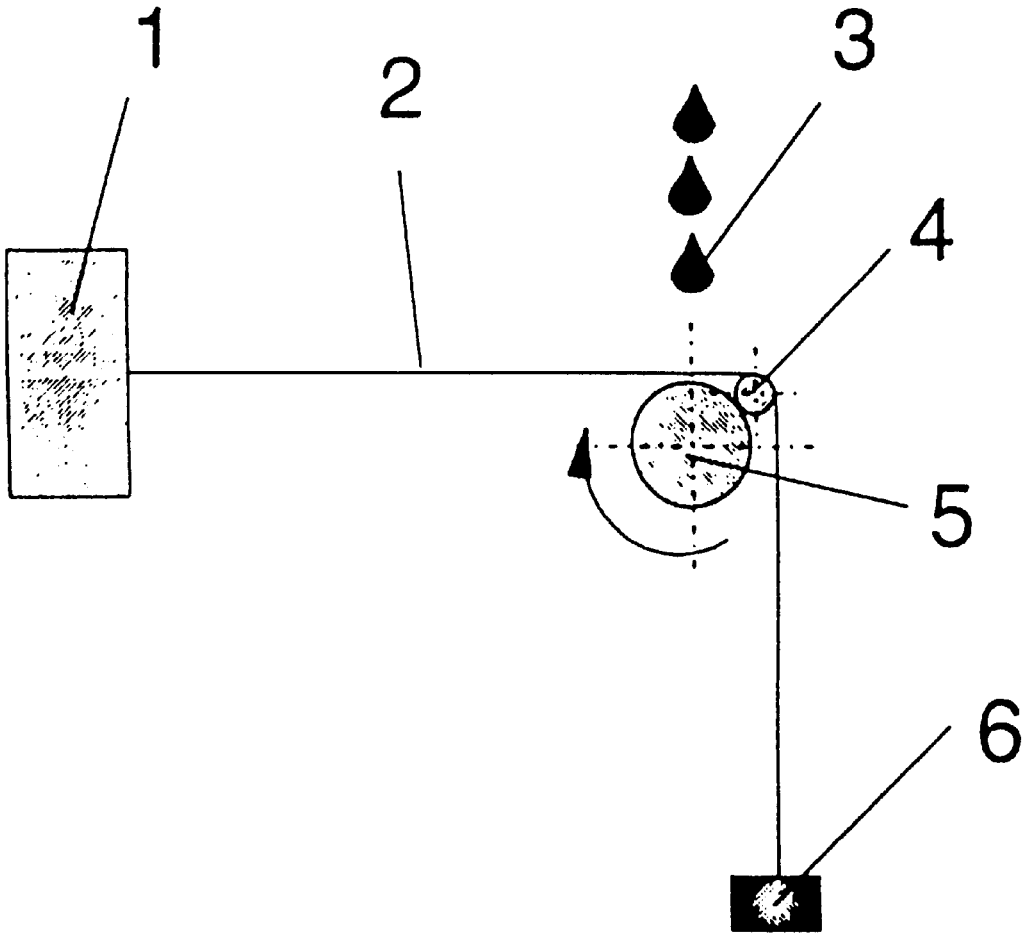

In contrast to the process in WO96/20301, in which at least two coagulation baths are employed, which reduce the solubility of the cellulose in amine oxide by various methods in order to generate a core-sheath structure in the fibers, the process of the present invention does not make use of coagulation media which reduce the solubility of the cellulose in amine oxide by different amounts. In the context of the present invention, the same or comparable coagulation agents such as aqueous NMMO are employed in all coagulation stages. The fibers made according to the process of the invention thus do not exhibit the pronounced core-sheath structure of WO96/20301, but in this regard exhibit a morphology which corresponds to that of conventional Lyocell fibers.

The cellulose solution is preferably formed into fibers through a heated spinneret with a plurality of holes. The formed solution is then cooled in an air gap and stretched by at least a factor of 1, preferably by more than a factor of 4.

The first coagulation stage is carried out in accordance with the invention such that only the adhesiveness of the surface of the solution formed into fibers has been counteracted. For this purpose, the fibers can be guided through a coagulation bath by means of a withdrawal component, such as a galette, arranged after the first coagulation stage. The required residence time of the fibers in the first coagulation stage can be adjusted for example by means of the length or depth of a coagulation bath and by means of the speed at which the fibers are guided through the coagulation bath, i.e., the spinning speed.

As the residence time of the fiber bundle in the first coagulation stage is reduced, there is an increase in the number of adhesions between the fibers which are adjacent after the single fibers have been brought together into a yarn. An adhesion of this type can be detected by laying a yarn section measuring about 10 to 15 cm in a dish of water. The fibers drift apart and adhesions can be identified easily. This test is repeated with five yam sections, which should not be consecutive. The number of adhesion points is a measure for the degree of fiber adhesion. For each spinning speed and for each titer, the number of fiber adhesions as a function of the length or the height of the first coagulation stage is determined. For the process in accordance with the invention, the length or the height of the first coagulation stage is selected for each spinning speed such that no more than one fiber adhesion occurs.

As the residence time in the first coagulation stage should be as short as possible, the optimization is conducted such that if for a given spinning speed the length or height of the coagulation bath is reached at which a maximum of one adhesion is achieved, a further check is made in a subsequent test as to whether a further reduction of the coagulation bath height or length leads to a rise in the number of adhesions. Thus, for a given spinning speed, precisely that residence time in the first coagulation stage is set at which the criterion of no more than one fiber adhesion is fulfilled.

In the context of the present invention, the term "slack state" is understood to mean that the fibers are under a tension no greater than that produced by their own weight.

In a preferred embodiment of the process the fibers (whereby in the context of this invention, fibers are also taken to mean filaments, i.e., so-called continuous fibers, which can also take the form of hollow fibers, as well as shorter fibers which are generally termed staple fibers) are laid on a perforated belt in a slack state for the further coagulation stages, i.e., after the first coagulation stage.

In the context of the present invention, it has proven advantageous to perform the coagulation in two stages, but it is decisively important for the first stage merely to prevent the adhesiveness of the surface of the fibers and for the actual coagulation of the fibers to take place in a slack state in the second stage.

The thorough coagulation of the fibers in the further coagulation stages or in the second coagulation stage is not performed in a separate bath in which another coagulation medium is employed, but takes place for example by means of the coagulation bath fluid from the first coagulation stage which the fibers carry along with them.

In order to maintain a low rate of thorough coagulation of the fibers in a slack state, it is advantageous for the fibers to transport only a small quantity of coagulation bath fluid from the first coagulation stage. In an advantageous embodiment of the process, the fibers in the further coagulation stages, i.e., on the perforated belt, for example, can be treated additionally with water in order to rinse off coagulation bath fluid already at this point.

It is also possible after the first coagulation stage to guide the fibers over two galettes such that the fibers sag freely between the galettes and whereby the coagulation in the second coagulation stage takes place by means of the coagulation agent from the first coagulation stage which the fibers carry along with them. In contrast to fibers which are guided over galettes without sag and thus under tension, the sagging fibers are tension-free within the meaning of the present invention. It is favorable if the amount of sag is approximately constant. This can be achieved by simply regulating the speed of the subsequent galettes. For example, the second galette can have a lower surface speed than the first galette.

The distance between the two galettes should be large, for example on the order of 2 m, in order to maintain the slack state of the fibers for as long as possible. Moreover it has also proven favorable for the fibers to be kept during drying at a tension of less than 1 cN/tex, preferably in a slack state.

As explained above, the fibers should only remain in the first coagulation stage for a very short time. In the process according to the invention, the residence time in the first coagulation stage should preferably only last until the fiber dimension is fixed and a skin has formed which prevents the fibers from sticking together. It is thus preferable for the fibers to be guided in a period $t_F$ less than 0.02 s (seconds) through the first coagulation stage, which is very advantageous if it takes the form of a funnel coagulation bath, as the height of the coagulation medium is very easily adjusted using a funnel coagulation bath, which is favorable for optimizing the number of fiber adhesions as described above.

Preferably, the coagulation medium used is aqueous NMMO with an NMMO concentration greater than 10%, in particular greater than 15%. The temperature of the coagulation medium in the first coagulation stage is preferably lower than 15° C., in particular lower than 8° C.

The process according to the invention is performed advantageously such that the quantity $K_F=t_F\cdot c/T$ is less than 12 s·m/g, preferably less than 10 s·m/g, where c represents the cellulose concentration of the solution in kg cellulose per kg solution (i.e., kg/kg), T is the single titer of the fibers in g/m and $t_F$ is the residence time in s in the coagulation bath. The single titer of a fiber is generally stated in dtex, whereby 1 dtex is defined as 1 g/(10,000 m). A fiber with a single titer of 2 dtex thus corresponds to 2 g/(10,000 m), i.e., 2·10 g/m.

For the manufacture of the cellulose solution, a cellulose is preferably used which consists of a mixture of raw cellulose with various degrees of polymerization (DP). The cellulose concentration in the solution should be, for example, less than 15% by weight, preferably less than 12% by weight, i.e., less than 0.15 or 0.12 kg cellulose per kg solution, respectively.

As explained above, the slack state of the fibers after the first coagulation stage should be maintained for a long period. The quantity $K_R=t_R\cdot c/T$ should thus be greater than 110 s·m/g, preferably greater than 190 s·m/g, where c represents the cellulose concentration of the solution in kg/kg, T is the single titer of the fibers in g/m and $t_R$ is the time in s during which the fibers are in a slack state.

The object is also fulfilled by cellulosic fibers manufactured from a solution of cellulose in a tertiary amine oxide and possibly water, whereby the fibers exhibit a characteristic F which is defined as $$F=-0.8754\cdot P-3.8532\cdot L(004)+19.2136\cdot L(110)+0.05395\cdot L(004)P-1.6483\cdot L(110)^2+4.4283\cdot L(004)/L(110)$$

and which is less than 4, and where P is the porosity of the fibers in %, L(110) signifies the crystallite width in nm and L(004) signifies the crystallite length in nm.

The characteristic F is preferably less than 3.3.

It is an advantage if the orientation of the fibers' amorphous regions $f_a$ is less than 0.46, particularly less than 0.39.

The crystallite width L(110) is preferably less than 3.5 nm, in particular less than 3.2 nm, and the crystallite length L(004) is preferably less than 14 nm, in particular less than 13.5 nm.

The birefringence is preferably less than 0.040, particularly less than 0.035, whereby this was determined on a dry fiber with a diameter of less than 15 $\mu$m.

As will be shown in the examples below, the fibers according to the invention only have a very limited tendency to fibrillate. The initial modulus of the fibers according to the invention is lower than that of conventional Lyocell fibers, the advantage of which is that woven fabrics made from the fibers according to the invention are soft to the touch.

To measure the fibrillation tendency of the fibers, the wet abrasion test apparatus shown schematically in the FIGURE is used. The wet abrasion test apparatus consists essentially of elements 1 to 6 which are explained below:

Fifty fibers 2 are fixed in a polyvinyl chloride (PVC) block 1. The abrasive stress is generated by guiding the fibers 2 over a rotating glass rod 5 with a diameter of 6 mm, to which is attached a ceramic rod 4 with a diameter of 2.5 mm. The glass rod 5, together with the ceramic rod 4, rotates at 25 rpm.

The fibers, which are made taut by a weight 6 of 3 g, are kept wet by sprinkling them with water 3. The wet abrasion test is performed for two minutes. The defined and reproducible formation of fibrils generated by the apparatus described is assessed on a scale of scores from 1 to 6 by means of microscopic assessment of the fiber regions subjected to abrasion, which are about 3 mm in length.

In order to assess the formation of fibrils generated by abrasion, it has proven advantageous to introduce the terms primary and secondary fibrillation.

Primary fibrillation means that fibrils are only observed on the surface of the fibers.

Secondary fibrillation means that the fibrils are also observed in deeper layers of the fibers. The further the secondary fibrillation progresses, the longer and thicker the fibrils become.

Using the terms just defined, a scale of scores from 1 to 6 was defined. In this scale, a score of 1 means no fibrillation at all, a score of 2 means slight primary fibrillation, a score of 3 means pronounced primary fibrillation, a score of 4 means slight secondary fibrillation, a score of 5 means pronounced secondary fibrillation a score of 6 means damage to the entire fiber surface by primary and secondary fibrillation, as observed in conventional Lyocell fibers which were not given any special treatment.

For each of the examples given below, the wet abrasion test is performed five times and a mean score is calculated.

The structural data, i.e., the orientation of the amorphous regions $f_a$, the orientation of the crystalline regions $f_c$, the crystallite length L(110), the crystallite width L(004) and the crystalline orientation angle and the birefringence of the fibers are determined by means of WAXS (wide angle X-ray scattering). For this purpose, a diffractometer made by STOE & CIE (45 kV, 40 mA, CU Kα) and a position-sensitive detector from the same company are used. The fibers examined are wound in parallel fashion onto small frames and measurement is performed in transmission.

The porosity of the fibers is calculated from the water retention capacity WRC of the fibers according to the following equation:

$$P=1/[1+(1/((WRC+1)\cdot\rho_{cell}))\cdot(\rho_{water}/(1-(WRC+1)^{-1}))]$$

where $\rho_{cell}$ signifies the density of cellulose (=1.5 g/ml) and $\rho_{water}$ signifies the density of water at 20° C. (=0.998 g/ml). The water retention capacity is determined according to the standard DIN 53814 (2/74).

As a measure of the dyeing level, the L-value is stated in % in the examples. The L-value is a measure of reflection. The lower the L-value, the higher the rate of dye uptake and thus the dyeing level. The L-value is determined on a knitted tube which has been dyed with solophenyl blue GL. The L-value is determined using a CHROMAMETER CR300 from the MINOLTA company.

In the following examples and comparative examples, Lyocell fibers are manufactured by spinning into fibers a solution of cellulose, NMMO, water and gallic acid propyl ester as a stabilizer, through a spinneret with 50 holes and a hole diameter of 130 μm. The spinneret temperature is 112° C., or 109° C. in Example 4. The fibers are stretched in an air gap 130 mm long, or 135 mm in Example 4, in the process of which air is blown perpendicularly onto the fiber bundle. A funnel coagulation bath is used

EXAMPLE 1

The spinning solution consisted of 9% by weight of a raw cellulose with a degree of polymerization (DP) of about 650, 1% by weight of a raw cellulose with a DP of about 6,000, corresponding to a cellulose concentration of 0.1 (kg cellulose/kg solution), 77.8% by weight NMMO, 12.1% by weight water and 0.1% by weight gallic acid propyl ester. After passing through the air gap, the fibers are coagulated in a funnel coagulation bath. The height of the fluid in the coagulation bath is 20 mm, and 25% aqueous NMMO at a temperature of 5° C. is used as the coagulation bath fluid.

The fibers emerging from the first coagulation stage are drawn off directly by means of a galette at a rate of 65 m/min and guided to a second galette. The second galette is at a distance of 2 m from the first galette and is operated at the same surface speed. The fibers are initially laid onto the galettes in such a manner that they sag freely between them. After leaving the second galette, the fibers are washed, finished and dried.

The properties of the fibers of the invention manufactured by this method are summarized in the table below together with the other fibers made according to the invention and fibers made according to comparative examples.

EXAMPLE 2

Cellulosic fibers are manufactured as described under Example 1. The fibers emerging from the coagulation bath are similarly drawn off directly after the coagulation bath by means of a galette at a rate of 65 m/min, but from there they are placed in a slack state onto a slow-moving perforated belt. On this belt, water treatment is performed after about 2 minutes in order to rinse out the remaining NMMO. Subsequently, the fibers are finished and dried and drawn off the perforated belt and wound on a bobbin.

EXAMPLE 3

The fibers are manufactured as described under Example 1. In this example, however, directly after the coagulation bath, the fibers are drawn off using a galette at a rate of 250 m/min and guided to a second galette at a distance of 2 m. The speed of the second galette is 3% lower than that of the first galette, and the fibers are in a slack state between the two galettes.

EXAMPLE 4

The spinning solution consisted of 10.5% by weight of a raw cellulose with a DP of about 650, 0.9% by weight of a raw cellulose with a DP of about 6,000, corresponding to a cellulose proportion of 0.114, 77.5% by weight NMMO, 11% by weight water and 0.1% by weight gallic acid propyl ester. After passing through the air gap, the fibers are coagulated in a funnel coagulation bath. The height of the fluid in the coagulation bath is 20 mm, and 15% aqueous NMMO at a temperature of 5° C. is used as the coagulation bath fluid.

The fibers emerging from the coagulation bath are drawn off by means of a galette at a rate of 100 m/min and placed on a perforated belt. There the fibers are washed, finished and dried in a slack state. They are then taken off the perforated belt and wound onto a bobbin.

EXAMPLE 5

Comparative Example

The spinning solution consisted of 9.6% by weight of a raw cellulose with a DP of about 650, 2.4% by weight of a raw cellulose with a DP of about 1,700, corresponding to a cellulose concentration of 0.12, 76.9% by weight NMMO, 11% by weight water and 0.1% by weight gallic acid propyl ester. After passing through the air gap, the fibers are coagulated in a funnel coagulation bath The height of the fluid in the coagulation bath is 38 mm, and 5% aqueous NMMO at a temperature of 15° C. is used as the coagulation bath fluid.

The fibers emerging from the coagulation bath are drawn off by means of a galette at a rate of 100 m/min and led directly to a continuous washing section over further galettes. In this example, the fibers did not sag between the galettes but are guided over them in a taut state, i.e., under tension.

After washing, the finishing, drying and winding up are also performed continuously.

EXAMPLE 6

Comparative Example

The spinning solution consisted of 10.5% by weight of a raw cellulose with a DP of about 650, 0.9% by weight of a raw cellulose with a DP of about 6,000, corresponding to a cellulose concentration of 0.114, 77% by weight NMMO, 11.5% by weight water and 0.1% by weight gallic acid propyl ester. After passing through the air gap, the fibers are coagulated in a funnel coagulation bath. The height of the fluid in the coagulation bath is 40 mm, and fully desalinated water at a temperature of 13° C. is used as the coagulation bath fluid.

The fibers emerging from the coagulation bath are drawn off with a galette at a rate of 100 ni/min and as in Example 5 are led directly over further galettes under tension to a continuous washing section. After washing, the finishing, drying and winding up are also performed continuously.

In the following table, the properties and data obtained for the fibers manufactured according to Examples 1 to 6 are summarized.

| Example | 1 | 2 | 3 | 4 | 5 | 6 |
|---|---|---|---|---|---|---|
| c (kg/kg) | 0.10 | 0.10 | 0.10 | 0.114 | 0.12 | 0.114 |
| T (dtex) | 2.2 | 2.2 | 2.2 | 2.2 | 2.2 | 1.6 |
| $t_F$ (s) | 0.0185 | 0.0185 | 0.0048 | 0.012 | 0.0228 | 0.024 |
| $K_F$ (s · m/g) | 8.4 | 8.4 | 2.2 | 6.2 | 12.4 | 17.1 |
| $t_F$ (S) | 1.8 | >9 | 0.5 | >6 | 0 | 0 |
| $K_F$ (s · m/g) | 818 | >4,000 | 227 | >3,000 | 0 | 0 |

-continued

| Example | 1 | 2 | 3 | 4 | 5 | 6 |
|---|---|---|---|---|---|---|
| Elongation at rupture (%) | 12.4 | 17.2 | 10.3 | 10.2 | 7.6 | 7.2 |
| Strength (cN/tex) | 23.1 | 20.4 | 23.0 | 21.7 | 38.4 | 33.0 |
| Modulus 0.6% (cN/tex) | 1275 | 826 | 1127 | 779 | 1654 | 1454 |
| Birefringence | 0.0394 | 0.0333 | 0.0351 | 0.0375 | 0.0438 | 0.0453 |
| Crystallinity (%) | 52.0 | 53.7 | 54.7 | 50.9 | 52.6 | 53.4 |
| Orientation in crystalline regions $f_e$ | 0.943 | 0.873 | 0.944 | 0.920 | 0.961 | 0.967 |
| Orientation in amorphous regions $f_a$ | 0.332 | 0.162 | 0.121 | 0.306 | 0.466 | 0.506 |
| Orientation angle | 29.5 | 33.7 | 32.5 | 30.9 | 26.3 | 25.1 |
| Porosity P (%) | 55.3 | 59.4 | 54.1 | 57.8 | 47.1 | 46.2 |
| L(110) (nm) | 2.9 | 3.0 | 3.1 | 2.9 | 3.9 | 4.1 |
| L(004) (nm) | 13.4 | 11.5 | 13.9 | 13.3 | 16.0 | 15.9 |
| Charact. qty. F | 2.3 | 0.3 | 3.2 | 1.8 | 5.8 | 6.2 |
| L-value (%) | 38.7 | 22.74 | 31.17 | 21.5 | 43.3 | 41.8 |
| Fibrillation score | 1.5 | 1 | 3 | 1.5 | 5.5 | 6 |

The data in the table demonstrate that fibers manufactured according to the invention (Examples 1 to 4) are characterized by a very low fibrillation tendency. With the exception of Example 3, where only a fibrillation score of 3 is achieved, the fibers showed no fibrillation at all (Example 2) or only a slight tendency to form primary fibrils (Examples 1 and 4). The conventional Lyocell fibers represented by the comparative examples (Examples 5 and 6), in contrast, exhibit pronounced secondary fibril formation.

The best fibrillation score is achieved with those fibers which are placed on the perforated belt in a slack state (Examples 2 and 4), whereby it is also apparent that the fibers that are kept in a slack state over a long period, i.e., longer than 9 s in Example 2, corresponding to a KR of greater than 4,000, give the best results.

The data also show that the fibers manufactured according to the invention have a lower L-value and thus a greater dyeing level than the fibers of the comparative examples. The advantage of greater dyeing level in the manufacture of textiles is that more rapid and intensive dyeing is possible and the options of dyeing with other materials, such as in blended wovens, are extended.

The examples thus demonstrate that with the process according to the invention, fibers with an extremely low fibrillation tendency can be manufactured effectively and under economical processing conditions, i.e., without employing further chemicals. As demonstrated by the data in the table, which are determined by wide angle x-ray scattering, the fibers according to the invention are characterized by a new structure compared with conventional Lyocell fibers. Although the strength of the fibers of the invention is lower than that of conventional Lyocell fibers, this is not a disadvantage for the utilization of the fibers in the textile field, as here no high strengths are required. Apart from the greater softness of touch of the textile flat structures mentioned above which the fibers according to the invention give rise to due to their lower modulus, the lower modulus of the fibers simplifies processing in the preparation of warp beams and yarn beams and their further processing on looms and knitting machines.

What is claimed is:

1. Cellulosic fibers made from a solution of cellulose in a tertiary amine oxide and optionally water, wherein the cellulosic fibers possess a characteristic F of less than 4, wherein $$F=-0.8754\cdot P-3.8532\cdot L(004)+19.2136\cdot L(110)+0.05395\cdot L(004)\cdot P-1.6483\cdot L(110)^2+4.4283\cdot L(004)/L(110)$$

where P represents the porosity of the fibers in %, L(110) is the crystallite width in nm and L(004) is the crystallite length in nm.

2. Cellulosic fibers in accordance with claim 1, wherein the characteristic F is less than 3.3.

3. Cellulosic fibers in accordance with claim 1, wherein an orientation of amorphous regions $f_a$ of the fibers is less than 0.46.

4. Cellulosic fibers in accordance with claim 1, wherein a crystallite width L(110) of the fibers is less than 3.5 nm.

5. Cellulosic fibers in accordance with claim 1, wherein a crystallite length L(004) of the fibers is less than 14 nm.

6. Cellulosic fibers in accordance with claim 1, wherein a birefringence of the fibers is less than 0.040.

7. Cellulosic fibers in accordance with claim 3, wherein the orientation of amorphous regions $f_a$ of the fibers is less than 0.39.

8. Cellulosic fibers in accordance with claim 5, wherein the crystallite length L(004) of the fibers is less than 13.5 nm.

9. Cellulosic fibers in accordance with claim 6, wherein the birefringence of the fibers is less than 0.035.

10. Cellulosic fibers made according to a process of claim 1 for the manufacture of cellulosic fibers, the process comprising:

forming a solution comprised of cellulose in a tertiary amine oxide and optionally water into fibers through a spinneret, coagulating fibers with a coagulation medium in at least two stages, wherein the residence time of the fibers in a first coagulation stage is adjusted so that on leaving the first coagulation stage only the adhesiveness of a surface of the solution formed into fibers has been counteracted, wherein in subsequent coagulation stages the fibers are kept in a slack state, and wherein the fibers leaving a final coagulation stage have been thoroughly coagulated, and subsequently washing and drying the fibers.

* * * * *

UNITED STATES PATENT AND TRADEMARK OFFICE

CERTIFICATE OF CORRECTION

PATENT NO. : 6,159,601 
DATED : December 12, 2000
INVENTOR(S) : Hans-Jürgen Pitowski and Ulrich Wigand Wachsmann It is certified that error appears in the above-identified patent and that said Letters Patent is hereby corrected as shown below:

Column 1,
Line 20, change "No. 4,246,22 1." to -- No. 4,246,221. --.

Column 3,
Line 6, change "yam" to -- yarn --.

Column 4,
Line 32, change "i.e., 2·10 g/m." to -- $2 \cdot 10^{-4}$ g/m. --.

Column 7,
Line 50, change "100 ni/min" to -- 100 m/min --;
Line 65, change "$t_F$ (S)" to -- $t_R$ (s) --; and
Line 66, change "$K_F$ (s · m/g)" to -- $K_R$ (s·m/g) --.

Column 8,
Line 38, change "KR" to -- $K_R$ --.

Signed and Sealed this

Seventeenth Day of September, 2002

*Attest:*

*Attesting Officer*

JAMES E. ROGAN
*Director of the United States Patent and Trademark Office*